US009574346B2

(12) United States Patent
Hammond

(10) Patent No.: US 9,574,346 B2
(45) Date of Patent: Feb. 21, 2017

(54) MODULAR SLAB AND MODULAR SURFACE SYSTEM

(71) Applicant: Precast Advanced Track Limited, Knutsford (GB)

(72) Inventor: John Hammond, Warwick (GB)

(73) Assignee: Precast Advanced Track Limited (GB)

( * ) Notice: Subject to any disclaimer, the term of this patent is extended or adjusted under 35 U.S.C. 154(b) by 0 days.

(21) Appl. No.: 14/620,038

(22) Filed: Feb. 11, 2015

(65) Prior Publication Data

US 2015/0152638 A1 Jun. 4, 2015

Related U.S. Application Data

(63) Continuation of application No. 13/557,278, filed on Jul. 25, 2012, now Pat. No. 8,973,318, which is a (Continued)

(30) Foreign Application Priority Data

Jan. 29, 2010 (GB) ..... 1001492.6

(51) Int. Cl.
*E04C 5/08* (2006.01)
*E04B 5/48* (2006.01)
(Continued)

(52) U.S. Cl.
CPC ..... *E04B 5/48* (2013.01); *E01B 1/002* (2013.01); *E01B 3/40* (2013.01); *E01C 5/005* (2013.01);
(Continued)

(58) Field of Classification Search
CPC ..... E04F 15/02; E04F 2201/0505; E04F 2201/0517; E01C 2201/16; E01C 9/086; E01C 5/20; E01C 5/005; E04C 5/125;E04C 2/38; E04C 2/20; E01D 2101/285; E04B 5/04; E04B 2001/3583; E04B 5/48; E04B 5/043; E01B 1/002; E01B 3/40
(Continued)

(56) References Cited

U.S. PATENT DOCUMENTS 511,497 A * 12/1893 Blaine ..... E01C 5/00 404/41
763,008 A * 6/1904 McKenzie ..... E01B 3/38 238/7
(Continued)

FOREIGN PATENT DOCUMENTS

DE 1 083 295 6/1960
DE 3111876 A1 6/1982
(Continued)

*Primary Examiner* — Adriana Figueroa
(74) *Attorney, Agent, or Firm* — Bose McKinney & Evans LLP

(57) ABSTRACT

A removable modular slab for use in the construction industry includes an upper surface, a lower surface, first and second opposing end surfaces, and a conduit extending from an aperture in the upper surface to an aperture in an end surface. The slab is end-to-end abuttable with a second removable modular slab, having: (i) a conduit extending from an aperture in the upper surface to an aperture in an end surface, and/or (ii) a cavity extending from an aperture in an end surface into the slab, whereby the conduits are mateable so as to form an elongate conduit through the two slabs. Such elongate conduit is accessible through the apertures in the upper surfaces of each slab. By such access, a first joining structure is removably locatable to join the two slabs together. Cavities may terminate within the second slab and only be accessible through the aperture in the upper surface of the first slab, into which a joining structure is removably
(Continued)

locatable to join the two slabs together. A modular surface system includes two such slabs and a joining structure to join the two slabs together.

32 Claims, 9 Drawing Sheets

Related U.S. Application Data continuation of application No. PCT/GB2011/000107, filed on Jan. 27, 2011.

(51) Int. Cl.

| | |
|---|---|
| ***E01B 1/00*** | (2006.01) |
| ***E01B 3/40*** | (2006.01) |
| ***E01C 5/00*** | (2006.01) |
| ***E04B 5/04*** | (2006.01) |
| ***E04C 2/20*** | (2006.01) |
| ***E04C 2/38*** | (2006.01) |

(52) U.S. Cl.
CPC ..... *E04B 5/043* (2013.01); *E04C 2/20* (2013.01); *E04C 2/38* (2013.01)

(58) Field of Classification Search
USPC ..... 52/223.6, 223.7, 223.9, 223.11, 583.1; 404/34–36, 40, 41, 45; 238/6–8
See application file for complete search history.

(56) References Cited

U.S. PATENT DOCUMENTS 1,237,542 A * 8/1917 Morgal ..... 404/40
1,842,828 A * 1/1932 Giuliani ..... E04B 2/56 52/284
1,912,429 A * 6/1933 Burgess ..... E01C 5/005 404/40
1,916,620 A * 7/1933 Johnson ..... E01C 5/08 404/41
1,991,931 A 2/1935 Kling et al.
3,286,418 A * 11/1966 Radford ..... E04B 5/043 52/223.6
3,704,564 A * 12/1972 Koga ..... C07F 5/02 264/321
3,971,181 A * 7/1976 Zetlin ..... E04B 5/43 52/263
3,994,436 A 11/1976 Sonneville
4,104,885 A * 8/1978 Thomas ..... 405/153
4,660,344 A 4/1987 Gaudelli et al.
5,098,218 A 3/1992 Reese et al.
5,625,999 A * 5/1997 Buzza ..... E04C 2/296 52/309.11
5,865,004 A 2/1999 Mitchell
5,906,456 A * 5/1999 Knight ..... E02B 3/14 404/41
6,058,672 A * 5/2000 McClellan ..... 52/587.1
6,071,041 A * 6/2000 Knight ..... E02B 3/14 404/40
6,243,994 B1 * 6/2001 Bernini ..... 52/86
6,324,805 B1 * 12/2001 Naniwa ..... 52/431
6,474,029 B1 * 11/2002 Cook et al. ..... 52/223.7
6,592,292 B1 * 7/2003 Jansson ..... 405/20
6,705,797 B1 * 3/2004 Wada ..... E01C 5/00 404/34
6,752,322 B2 * 6/2004 Ehrsam ..... E01B 9/62 238/283
7,114,302 B2 * 10/2006 Tanase ..... E04B 5/32 52/126.6
7,134,805 B2 * 11/2006 Yee ..... 404/50
7,270,497 B2 * 9/2007 Von Langsdorff ..... E01C 5/005 404/29
7,849,654 B2 * 12/2010 Ban ..... E01C 5/005 52/582.1
8,091,797 B2 * 1/2012 Reichel et al. ..... 238/8
2004/0182946 A1 * 9/2004 Reichel ..... E01B 1/004 238/5

FOREIGN PATENT DOCUMENTS

| | | |
|---|---|---|
| DE | 197 33 909 A1 | 2/1999 |
| EP | 0 726 361 A1 | 8/1996 |
| FR | 1142610 | 9/1957 |
| FR | 2 244 871 | 4/1975 |
| GB | 3010403 | 1/2003 |
| WO | WO 2004/033798 A1 | 4/2004 |

* cited by examiner

MODULAR SLAB AND MODULAR SURFACE SYSTEM

RELATED APPLICATIONS

This application is a continuation of U.S. application Ser. No. 13/557,278, filed on Jul. 25, 2012, which is a continuation of PCT/GB2011/000107, filed Jan. 27, 2011, which claims priority to GB 1 001 492.6, filed Jan. 29, 2010, all three of which are hereby incorporated by reference in their entirety.

BACKGROUND

The present invention relates to a slab for use in the construction industry, especially to a modular construction slab, to a modular surface system including such slabs, and to a method of joining construction slabs.

It is well known in the construction industry to use slabs, especially concrete or concrete-derivative slabs, as building components. Such slabs find use as flooring components for buildings, public highways and the like. When two or more such known slabs are connected together, it is typically with some kind of internal tie that runs through the interior length and/or width of the slabs.

The problem with a system incorporating such slabs and ties is that, once the slabs have been joined together by the internal ties, if any adjustment, rectification or replacement of a slab or tie is required, the only way to access the tie to disconnect the appropriate slabs is by destroying at least a part of the slab and or tie as is necessary. This is both costly and time consuming because any part that has been even partially destroyed will typically need to be replaced, thereby rendering the system unavailable for a period of time until the rectification work has been completed.

It would therefore be desirable to provide an improved slab for use in the construction industry, and an improved method of joining slabs, neither of which suffer from the aforementioned problems.

SUMMARY

Accordingly, in a first aspect, an exemplary embodiment provides a removable modular slab for use in the construction industry, and includes an upper surface, a lower surface opposed to the upper surface, first and second opposing end surfaces between and substantially normal to the upper and lower surfaces, and a conduit extending from an aperture in the upper surface to an aperture in an end surface. The slab is end-to-end abuttable with a second removable modular slab, the second slab having an upper surface, a lower surface opposed to the upper surface, and first and second opposing end surfaces between and substantially normal to the upper and lower surfaces. The second slab is provided with one or both of: (i) a conduit extending from an aperture in the upper surface thereof to an aperture in an end surface thereof, and (ii) a cavity extending from an aperture in an end surface into the second slab, whereby the conduit in the first-mentioned slab is mateable with the conduit in the second slab so as to form an elongate conduit through the ends of the two slabs, which is accessible through the apertures in the upper surfaces of each slab, and through which a first joining means is removably locatable to join the two slabs together. In an alternative exemplary embodiment, the conduit in the first-mentioned slab is mateable with the cavity in the second slab so as to form an elongate cavity through the ends of the two slabs, which terminates within the second slab and which is only accessible through the aperture in the upper surface of the first-mentioned slab, into which a second joining means is removably locatable to join the two slabs together.

The first aspect of the disclosure also provides a second removable modular slab for use in the construction industry with the aforementioned removable modular slab of the preceding paragraph, such second slab including an upper surface, a lower surface opposed to the upper surface, first and second opposing end surfaces between and substantially normal to the upper and lower surfaces, and a cavity extending from an aperture in an end surface thereof into the second slab. The second slab is end-to-end abuttable with the aforementioned slab, whereby the cavity is mateable with a conduit of the aforementioned slab so as to form an elongate cavity through the ends of the two slabs, which terminates within said second slab and which is only accessible through the aperture in the upper surface of the aforementioned slab, in which a second joining structure is removably locatable to join the two slabs together.

Provision of a removable modular slab of this type is advantageous because, firstly, the modular aspect means that the slabs have reproducible and predictable dimensions, and so can be more easily and accurately aligned. Secondly, the slabs can be rapidly installed, whether during initial installation or subsequent replacement, and readily adjusted with minimal disruption and cost. In this regard, the upper surface of the slab is preferably an exposed surface, i.e. it is readily accessible, as are the apertures therein.

Preferably at least one of the first and second opposing end surfaces of one slab is profiled such that a cooperative joint is formable with a profiled end surface of the other slab when the two slabs are abutted together.

Advantageously, the end surface profile of one slab includes a protrusion and the end surface profile of the other slab includes a corresponding concavity. Thus, when the end surface of one slab and the end surface of the other slab are brought into abutment, the surfaces and profile mate so as to form an intimate joint. Through this joint, the elongate conduit or elongate cavity may extend, and thus also the first or second joining structure for joining the two slabs.

Further advantageously, the protrusion and the concavity may be shaped such that the end surface of each (i.e. that surface which would lie flush with the remainder of the end surface of the slab if the protrusion were flattened or the concavity shrunk) is at an angle of 45° or less to the vertical, preferably less than 25°, further preferably less than 15° and most preferably in the range of from 1-5° to the vertical.

The end surface profile of one slab may extend along the length of the end surface of the slab, and correspondingly the other slab also. However, it is not essential that the mating surfaces have such an extent. Indeed, the end surface profile may extend only part-way along the length of the end surface of both slabs; the profile may be positioned towards the center of the width of the end surface of the slabs, or it may extend from one end of the end surface.

In another exemplary embodiment, a removable modular slab may have two identically profiled end surfaces, and as such will be referred to as a type-A slab. The other modular slab, against which a type-A slab is abuttable, may also have two identically profiled end surfaces, which are different from, but cooperable with, the type-A slab, and this other slab will be referred to as a type-B slab. A type-A slab may have, for example, two end surfaces that are each provided with a concavity, and a type-B slab may have, for example, two end surfaces that are each provided with a protrusion, the concavities and protrusions being of complementary and cooperative shape. With such type-A and type-B slabs, a row of multiple slabs following the pattern A-B-A-B-A-B- (etc.) may be provided.

In an exemplary alternative embodiment, a removable modular slab may have two differently profiled end surfaces, and as such will be referred to as a type-C slab. The profile of one of the end surfaces of a type-C slab may be cooperable with the profile of the other end surface, such that one type-C slab is abuttable against a further type-C slab. For example one of the end surfaces of a type-C slab may be provided with a concavity whilst the other end surface may be provided with a protrusion. With such type-C slabs, a row of multiple slabs following the pattern -C-C-C-C-C- (etc.) may be provided.

A removable modular slab as hereinbefore described may be pre-cast or pre-moulded from a construction material. Any suitable material known in the art may be used; however, concrete or a concrete-derivative material, such a glass-fibre reinforced concrete (GFRC) or glass-fibre reinforced plastic (GFRP). Other components may include rebar or a plastics material. Plastic may be preferred for its inherent strength, corrosion-resistance, and electrical current-resistance.

A modular slab may have one or more voids, such as longitudinal voids, provided within it, thereby reducing its weight, compared to a full-density slab, without compromising its strength. These voids may remain empty or may be filled with a lightweight filler material, such as an aerated/foamed rubber. Advantageously, this filler material may also absorb vibrations if and when the slab is subjected to vibrational forces.

Additionally, a modular slab may include one or more channels in its first surface, such as for drainage purposes and/or for accommodation of cables, such as electricity cables. Furthermore, longitudinal ducts may be provided alongside the one or more channels for accommodation of cables and/or into which surface water may drain. Moreover, the longitudinal ducts may be crossed by transverse ducts within the slab.

A second aspect of the disclosure provides a modular surface system for use in the construction industry, and includes two modular slabs, both having a conduit extending from an aperture in their upper surfaces to an aperture in their end surfaces, wherein the first joining structure is removably locatable through the elongate conduit.

In practice, any number of modular slabs may be joined together in this manner, and indeed may be joined linearly, to form an elongate surface, or multi-directionally to form a more expansive surface area.

Advantageously, the first joining structure may be removably locatable in the elongate conduit. Furthermore, the first joining structure may be adjustably locatable in the elongate conduit. In both cases, the ease of accessibility to the first joining structure, as a result of the configuration of the conduits in the slabs, enables adjustment, alignment and replacement of a modular slab within this modular surface system in a quick, easy and low cost manner.

In an exemplary embodiment, the elongate conduit is arcuate or parabolic; the conduit is open at both ends in the upper surfaces of two adjacent modular slabs and may arc between adjacent end surfaces of the slabs. Correspondingly, the first joining structure may be a curved, tensionable cable or tie, or a flexible bar connector. When a cable is located in the elongate conduit via the upper surfaces in two adjacent modular slabs, the lower part of the cable may be subjected to tensile forces whilst the upper part of the cable may be subjected to compressive forces. Thus when a force is applied to the cooperative joint between the two slabs, the distribution of forces within the cable retains the alignment of the slabs. In this way, the slabs act collectively as a monolithic structure.

The first joining structure may be fastenable and tensionable at the upper surfaces of each slab, providing easy access to the first joining structure in the event that realignment or replacement of one or more slabs is required.

The second aspect of the present disclosure also accordingly provides a modular surface system for use in the construction industry, and includes two modular slabs, one having a conduit extending from an aperture in its upper surface to an aperture in its end surface and one having a cavity extending from an aperture in its end surface into its body, as hereinbefore described, and a second joining structure to join the two slabs together, wherein the second joining structure is removably locatable in the elongate cavity.

Again, any number of modular slabs may be joined together in this manner, and indeed may be joined linearly, to form an elongate surface, or multi-directionally to form a more expansive surface area.

Advantageously, the second joining structure may be removably locatable in the elongate cavity. Furthermore, the second joining structure may be adjustably locatable in the elongate cavity. In both cases, the ease of accessibility to the second joining structure, as a result of the configuration of the mating conduit and cavity in the slabs, enables adjustment, alignment and replacement of a modular slab within this modular surface system in a quick, easy and low cost manner.

In one exemplary embodiment, the elongate cavity is arcuate, parabolic or linear; the cavity is open at one end only in the upper surface of one of the adjacent modular slabs and terminates in the body of the other slab. Correspondingly, the second joining structure may be a curved, tensionable cable or tie, or a flexible bar connector.

The second joining structure is preferably anchored at the terminal end of the elongate cavity within one slab and tensionable at the upper surface of the other slab, providing easy access to the second joining structure in the event that realignment or replacement of one or more slabs is required.

As described above, a modular slab may be of one of three types: type-A, type-B or type-C. A modular surface system may comprise both type-A and type-B cooperative modular slabs. Alternatively, however, the system may comprise just one type of slab: type-C.

In various embodiments, a modular surface system may be used widely in the construction industry. However, it also finds particular use as a railway or metro track support. Typically, a railway is constructed from a foundation or sub-grade material on top of which a layer of ballast is laid. The purpose of the ballast layer is to provide a level substrate for the sleepers to be laid upon, and then for the railways tracks themselves to be fastened to the sleepers. The problem with this construction is that the ballast layer and the sleepers are prone to degradation due to the elements, i.e., water, snow and ice can penetrate, leading to track misalignment. Realignment of such a track is often costly and time-consuming, and is often accompanied by significant delays to rail traffic, thereby reducing track availability and capacity.

Use of a modular surface system as a railway track support minimises these problems by replacing the sleepers with modular slabs. The railway track may be supportable on the first surfaces (typically the upper surfaces) of the modular slabs, which themselves may be laid directly onto an existing ballast layer as a foundation. Alternatively, the foundation may be in the form of recycled or hydraulically stabilised ballast, or it may simply be earth. The ballast layer would be mostly covered and protected from the elements by the slabs, and the improved joining structure between the slabs thereby creates a contiguous structure.

Alternatively, the metro track may be embedded into the first surface (typically the upper surface) of the slabs.

In practice, a plurality of modular slabs may be joined with a joining structure to form a monolithic railway/metro track support, without the need for additional concrete to provide strength, as a long-term solution and alternative to ballasted railway tracks. This may be particularly advantageous in tunnels, crossovers and switches, level crossings and in locations where poor ground conditions exist; also for light rail applications in urban areas (for example, an urban light railway) where rapid installation is essential to minimise disruption to traffic in the locality.

Of course, there are many other uses for the disclosed modular slab and modular surface system, including, without limitation, as flooring in a building, for a highway, in airports (such as for a runway) and at ports or freight terminals (to form the hardstanding). The disclosed modular slab and modular surface system may be utilised in non-horizontal (or at least, non-ground) applications, for example in the walls of retaining structures and for temporary or emergency structures.

A third aspect of the present disclosure provides a method of removably joining two construction slabs, each having an upper surface, a lower surface opposed to the upper surface, and first and second opposing end surfaces between and substantially normal to the upper and lower surfaces, and each having a conduit extending from an aperture in the upper surface thereof to an aperture in an end surface thereof The method includes end-to-end abutting the two slabs, such that the conduit in one slab is mateable with the conduit in the other slab so as to form an elongate conduit through the ends of the two slabs, and removably locating a first joining structure through the elongate conduit such that each end of the first joining structure is accessible via the upper surface of each slab.

The third aspect of the present disclosure also provides a method of removably joining two construction slabs, each having an upper surface, a lower surface opposed to the upper surface, and first and second opposing end surfaces between and substantially normal to the upper and lower surfaces, one slab having a conduit extending from an aperture in the upper surface thereof to an aperture in an end surface thereof and the other slab having a cavity extending from an aperture in an end surface thereof into said slab. The method includes end-to-end abutting the two slabs, such that the conduit in one slab is mateable with the cavity in the other slab so as to form an elongate cavity through the ends of the two slabs, and removably locating a second joining structure through the elongate cavity which terminates within the other slab such that the second joining structure is only accessible via the upper surface of the first slab.

This method of joining is applicable with the modular slabs according to the first aspect of the disclosure, and in the modular surface system according to the second aspect of the disclosure. However, it is also applicable to other slabs which facilitate access to a joining structure through their upper surfaces, which in the case of retaining structures or emergency structures, may be outer vertical or substantially vertical surfaces.

The method may further include the steps of subsequently anchoring/fastening and tensioning the joining structure, which avoids the need to use jointing materials to harden or cure before the slab construction is brought into use.

The foregoing summary does not limit the invention, which is defined by the attached claims. Similarly, neither the Title nor the Abstract is to be taken as limiting in any way the scope of the claimed invention.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

Figure 1:
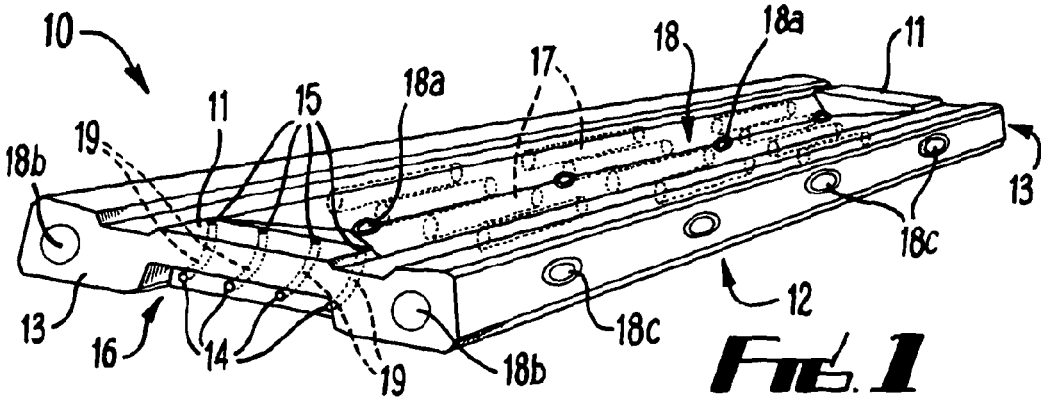
FIG. 1 is a perspective view of a modular slab, according to an exemplary embodiment.
Figure 2:
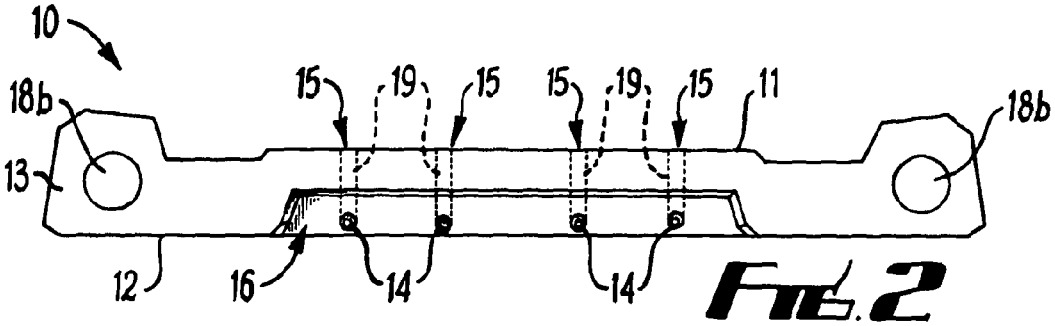
FIG. 2 is an end elevation of the modular slab shown in FIG. 1.

FIGS. 1 and 2 show a modular slab 10 comprising a first surface, in the form of an upper surface 11, a second surface, in the form of a lower surface 12 and two opposing end surfaces 13. The slab 10 is elongate in the direction between the two end surfaces 13. The end surfaces 13 of the slab 10 are each profiled to form a concavity 16. This profile extends part-way along the length of, and is centred on, the end surface 13. Located within the concavity 16 are four apertures 14, which correspond to a further four apertures 15 located in the upper surface 11 of the slab 10, adjacent to the end surface 13. A conduit 19 (shown in dotted outline) extends between each pair of apertures, joining them.

Slab 10 also includes longitudinal voids 17 (shown in dotted outline) which may be filled with foamed rubber to both reduce the overall weight of slab 10 (compared to a similar slab formed without voids) and to dampen any vibrations through it without compromising its strength. Additionally, a central elongate channel 18 is provided along the longitudinal axis of the slab, along with drainage outlets 18*a*, for drainage of surface water which may otherwise stagnate on the slab's upper surface 11. On either side of channel 18 within the body of slab 10, two longitudinal ducts 18*b* may be provided, along with optional transverse ducts 18*c*.

Figure 3:
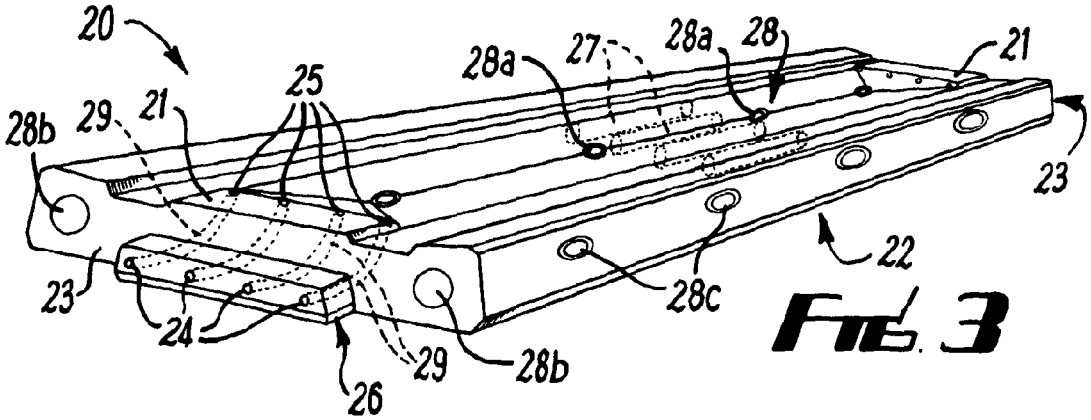
FIG. 3 is a perspective view of an alternative modular slab, according to an exemplary embodiment.
Figure 4:
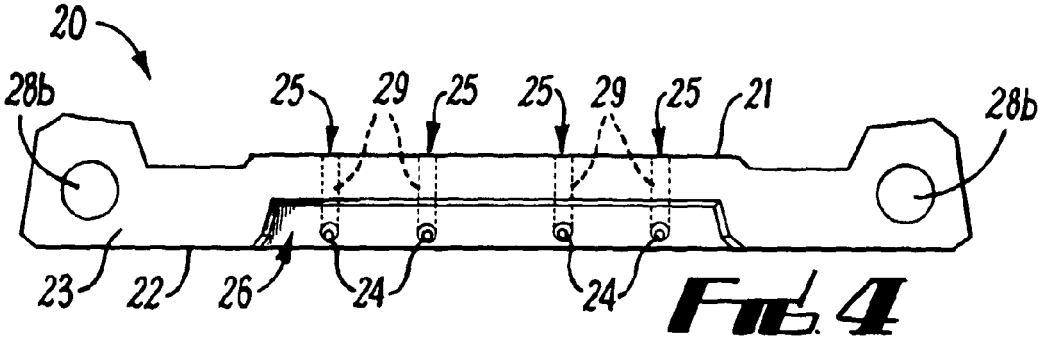
FIG. 4 is an end elevation of the modular slab shown in FIG. 3.

FIGS. 3 and 4 show a modular slab 20 similar to slab 10 shown in FIGS. 1 and 2, in that slab 20 includes a first surface, in the form of an upper surface 21, a second surface, in the form of a lower surface 22 and two opposing end surfaces 23. The slab 20 is elongate in the direction between the two end surfaces 23. Slab 20 also includes longitudinal voids 27 (shown in dotted outline) which may be filled with foamed rubber to both reduce the overall weight of slab 20 (compared to a similar slab formed without voids) and to dampen any vibrations through it without compromising its strength. Additionally, a central elongate channel 28 is provided along the longitudinal axis of the slab, along with drainage outlets 28*a*, for drainage of surface water which may otherwise stagnate on the slab's upper surface 21. On either side of channel 28 within the body of slab 20, two longitudinal ducts 28*b* may be provided, along with optional transverse ducts 28*c*.

Slab 20 differs from slab 10 in that the end surfaces 23 of the slab 20 are each profiled to form a protrusion 26. This profile extends part-way along the length of, and is centred on, the end surface 23. Located on the protrusion 26 are four apertures 24, which correspond to a further four apertures 25 located in the upper surface 21 of the slab 20, adjacent to the end surface 23. A conduit 29 (shown in dotted outline) extends between each pair of apertures, joining them.

For the avoidance of doubt, although only four conduits have been described with reference to slabs 10 and 20, any number of conduits as is deemed necessary to secure two slabs together may be provided. The conduits may be of varying diameter and may be dissimilar to one another, dependent upon the degree of tension to be applied to the joining structure (e.g., tensionable cable).

Figure 5:
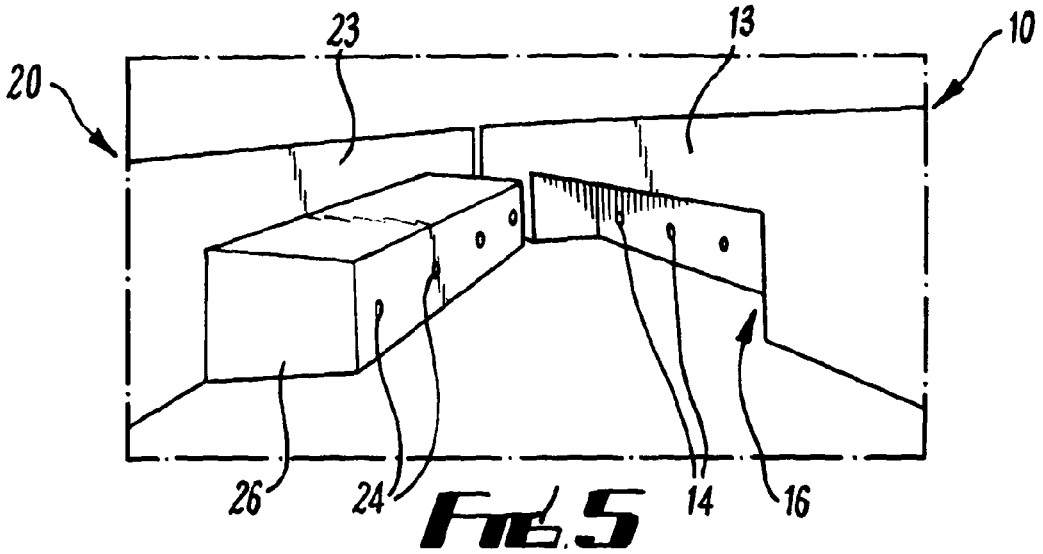
FIG. 5 is a perspective view of the end surfaces of two modular slabs, according to an exemplary embodiment (shown in FIGS. 1 to 4)

FIG. 5 shows two modular slabs 10,20, and in particular the manner in which the two slabs are end-to-end abuttable. Slab 10 is as shown in FIGS. 1 and 2, whilst slab 20 is as shown in FIGS. 3 and 4. When slabs 10, 20 are brought into end-to-end contact, protrusion 26 fits snugly into concavity 16 to form an intimate joint. In this joint, the conduits (not shown) that extend between the apertures 14, 24 in the end surfaces 13, 23 and the apertures 15, 25 in the upper surfaces 11, 21 of each slab 10, 20 meet and are aligned such that an elongate conduit (not shown), which extends from the upper surface 11 of slab 10 to the upper surface 21 of slab 20, is formed.

Figure 6:
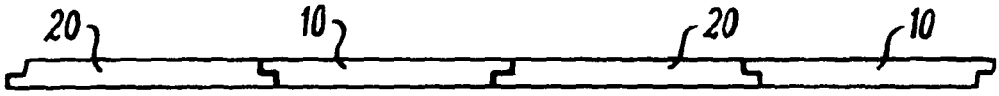
FIG. 6 is a side elevation of a plurality of modular slabs, according to an exemplary embodiment (shown in FIGS. 1 to 5)

FIG. 6 illustrates how a number of slabs 10 are joined to a number of slabs 20 to form a continuous monolithic surface. It is clear that should a slab 10 need to be removed from the system, it may be upwardly removed simply and in a nondestructive manner. The slabs 10, 20 may be a pair of type-A, having identically profiled protrusions on their end surfaces, and type-B, having identically profiled concavities on their end surfaces, slabs. The advantage with this configuration is that, should it be necessary, a type-B slab can be lifted outwardly of the system and away from its adjacent type-A slabs. Alternatively, the slabs 10, 20 may both be type-C slabs, having a protrusion formed on one end surface and a concavity formed on the opposing end surface. Furthermore, although the slabs 10, 20 have been described as having only two of their end surfaces profiled, one or both of their long-edge surfaces may also be profiled to enable joints to be formed at all four edges.

Figure 7:
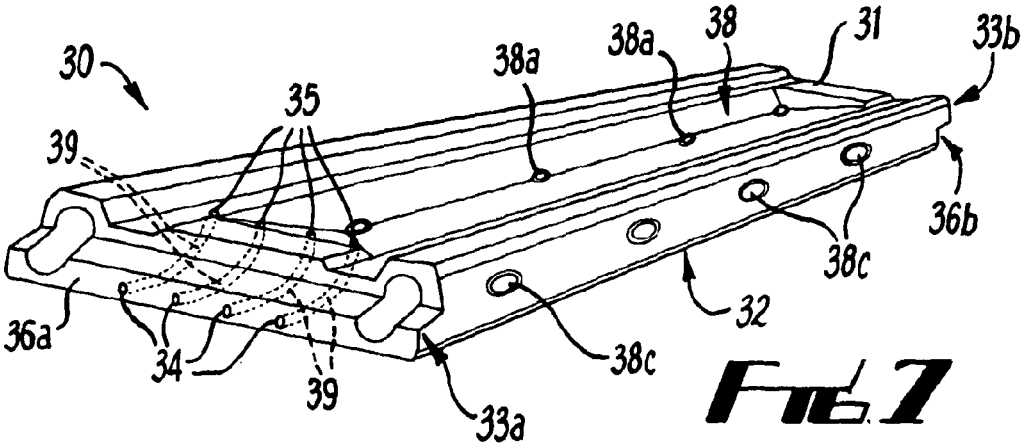
FIG. 7 is a perspective view of a further modular slab that is an alternative to that shown in FIGS. 1 to 4.

Turning now to FIG. 7, this shows an alternative slab 30, which is quite similar to slabs 10, 20, in that it comprises a first surface, in the form of an upper surface 31, a second surface, in the form of a lower surface 32 and two opposing end surfaces 33*a*, 33*b*, between and substantially normal to the first and second surfaces. The slab 30 is elongate in the direction between the two end surfaces 33*a*, 33*b*. The end surface 33*a* of the slab 30 is however profiled to form a protrusion 36*a* (rather than a concavity). This profile extends along the full length of the end surface 33*a*. End surface 33*b* is profiled to form a concavity 36*b*, which also extends along the full length of surface 33*b*. Located on end surface 33*a* of the protrusion 36*a* are four apertures 34, which correspond to a further four apertures 35 located in the upper surface 31 of the slab 30, adjacent to the end surface 33*a*. A conduit 39 (shown in dotted outline) extends between each pair of apertures, joining them.

Furthermore, slab 30 comprises a central elongate channel 38 along the longitudinal axis of the slab 30, along with drainage outlets 38*a*. Optionally transverse ducts 38*c* may be provided within the body slab 30 also. Slab 30 may be described as a type-C slab, having a protrusion formed on one end surface and a concavity formed on the opposing end surface.

Figure 8:
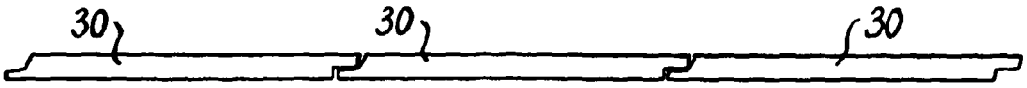
FIG. 8 is a side elevation of a plurality of modular slabs, according to an exemplary embodiment (shown in FIG. 7)

When slab 30 is end-to-end abutted with a further slab, this further slab may be profiled to form a concavity, which extends along the full length of its end surface, and which is provided with correspondingly located apertures and conduits, thereby forming a -C-C-C-C- (etc.) type modular system, as is illustrated in FIG. 8.

Figure 9:
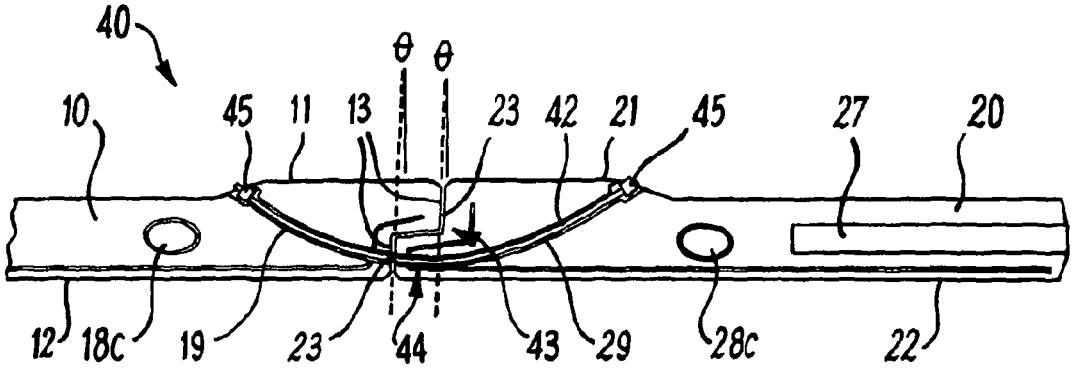
FIG. 9 is a side elevation of a modular surface system, according to an exemplary embodiment.

FIG. 9 shows a modular surface system 40 comprising, in this instance, two slabs 10, 20 of the type herein described. Slabs 10, 20 are end-to-end abutted to form a cooperative joint 43, such that the individual conduits 19, 29 in each slab meet and join to form an elongate conduit 44, which extends between the two slabs 10, 20. Through conduit 44 a first joining structure 42, in the form of a flexible wire cable which can be made to follow an arcuate path, is located. Each end of the joining structure 42 is provided with fastening and tensioning means 45 to lock the slabs 10,20 into position and to provide strength to the joint 43.

Cooperative joint 43 is profiled such that the end surfaces 13,23 that form the concavity 16 and protrusion 26 respectively lie at an angle of 5-10° to the vertical (as is shown by the angle 8 annotated on the drawing). By providing the surfaces of the joint in this manner, the two slabs 10,20 are easier to align when laying the system 40.

Any two or more slabs 10,20 may be joined according to the following:

prepare a surface, for example a sub-soil layer (not shown) and a top-ballast layer (not shown), by levelling it;

lay two slabs 10, 20 in end-to-end abutment such that their profiled surfaces 13, 23 meet and a plurality of elongate conduits 44 are formed between the two;

locate a joining structure, for example a cable 42, in each elongate conduit 44 by feeding it through an aperture 15 in the upper surface 11 of slab 10 until it appears through the corresponding aperture 25 in the upper surface 21 of slab 20; and affix a fastening and tensioning structure 45 to each accessible end of each cable 42 to lock them into position and subsequently apply tension to them, which will tighten the joint 43 between the two slabs 10, 20.

This method is equally applicable to the laying and joining of two or more slabs 30.

Figure 10:
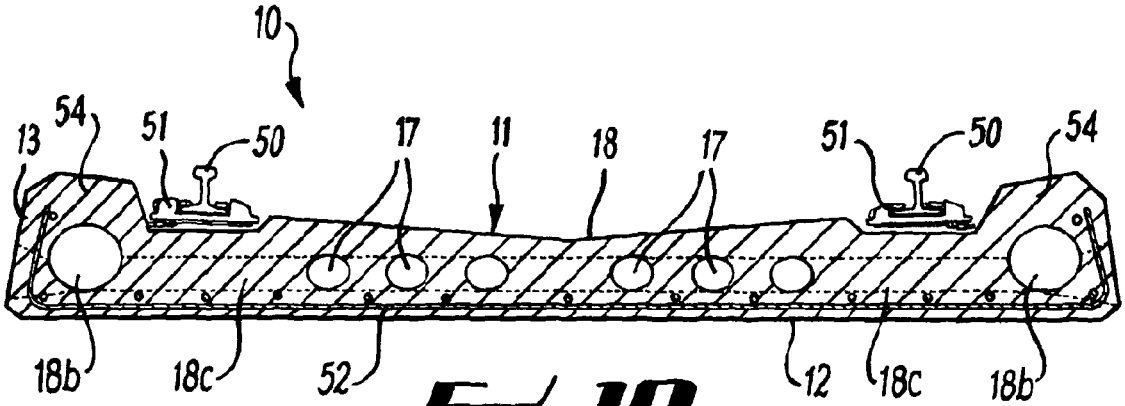
FIG. 10 is a transverse section through a modular slab, according to an exemplary embodiment.

FIG. 10 shows the slab 10 of FIGS. 1 and 2 in use as a railway track support. Slab 10 is laid on a foundation surface (not shown) and is provided with a railway track 50 and a fixing 51 for fixing the track 50 to the upper surface 11 of slab 10. Instead of using GFRP concrete, a reinforcement rod 52 is provided within the body of slab 10, in this instance adjacent to the lower surface 12 of the slab and extending up the side of the slab. Rod 52 may continue around ducts 18*b* and adjacent the upper surface 11 of the slab to form a reinforcement loop. As an additional safety feature, slab 10 includes an optional raised portion 54, which extends longitudinally down each side of the upper surface 11, and is located outboard of track 50. Should a train travelling on tracks 50 become de-railed, raised portion 54 helps prevent the train from toppling over and coming off the slab track, thereby further increasing rail safety.

Figure 11:
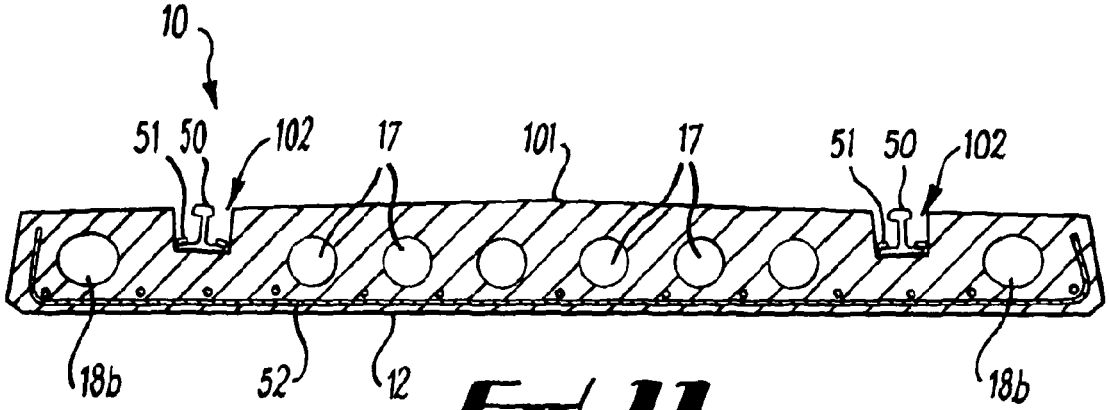
FIG. 11 is a transverse section through an alternative modular slab, according to an exemplary embodiment.

FIG. 11 also shows the slab 10 of FIGS. 1 and 2 in use as a railway support. Slab 10 is again provided with a railway track 50 and a fixing 51, however the upper surface 11 has been modified to include a raised-profile portion 101—the center of the slab is of greater depth when viewed in section compared to the outer edges of the slab, with tapering of the depth from the centre to the outer edges. Furthermore, upper surface 11 is provided with two longitudinal recesses 102 which accommodate the track 50 and fixing 51 components. In this way, the track 50 is effectively embedded in the slab 10, which may be especially useful when a railway track needs to be lowered to increase the clearance when laid in a tunnel or under a bridge, or at level crossings and locomotive maintenance yards, where it allows for maintenance work to take place as a result of the access possible with normal road vehicles.

Figure 12:
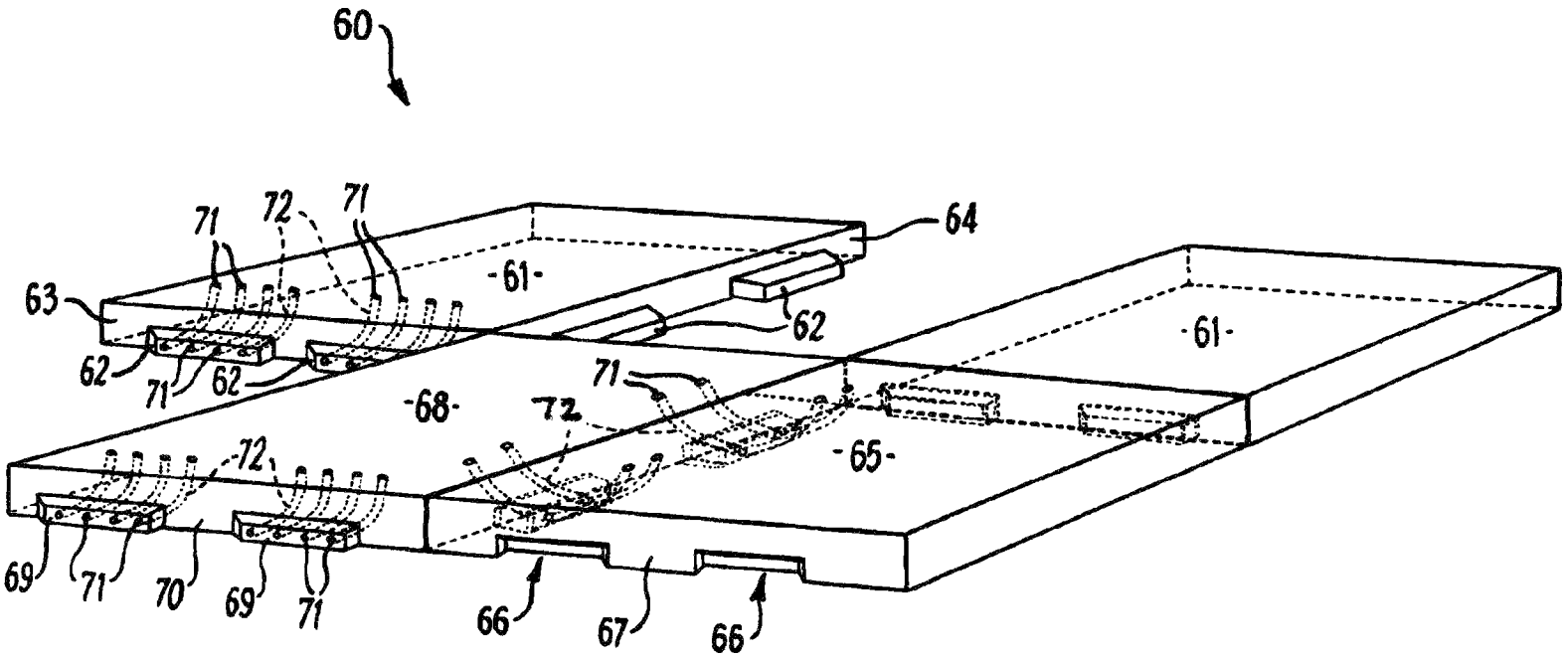
FIG. 12 is a perspective view of a plurality of modular slabs, according to an exemplary embodiment.

FIG. 12 illustrates a network 60 of slabs which are joined to form a more expansive surface area than would be achieved by merely joining slabs end-to-end. In FIG. 12 there are provided different types of slabs, having profiles formed on end surfaces and/or side surfaces as necessary to enable connections to be made to adjacent slabs as appropriate. In particular, FIG. 12 shows slabs 61 having profiles in the form of a pair of protrusions 62 on one end surface 63 and one side surface 64, slab 65 having profiles in the form of a pair of concavities 66 formed in both end surfaces 67 and one side surface, and slab 68 having profiles in the form of a pair of protrusions 69 formed in both end surfaces 70 and both side surfaces.

Apertures 71 and conduits 72 are appropriately located such that elongate conduits 72 are formed when the different slabs are abutted, enabling joining of said slabs in two directions (i.e. in an x-direction and in a y-direction) thereby formed a mosaic of slabs. In the case of a network 60, the slabs may be square-shaped rather than elongate.

Figure 13:
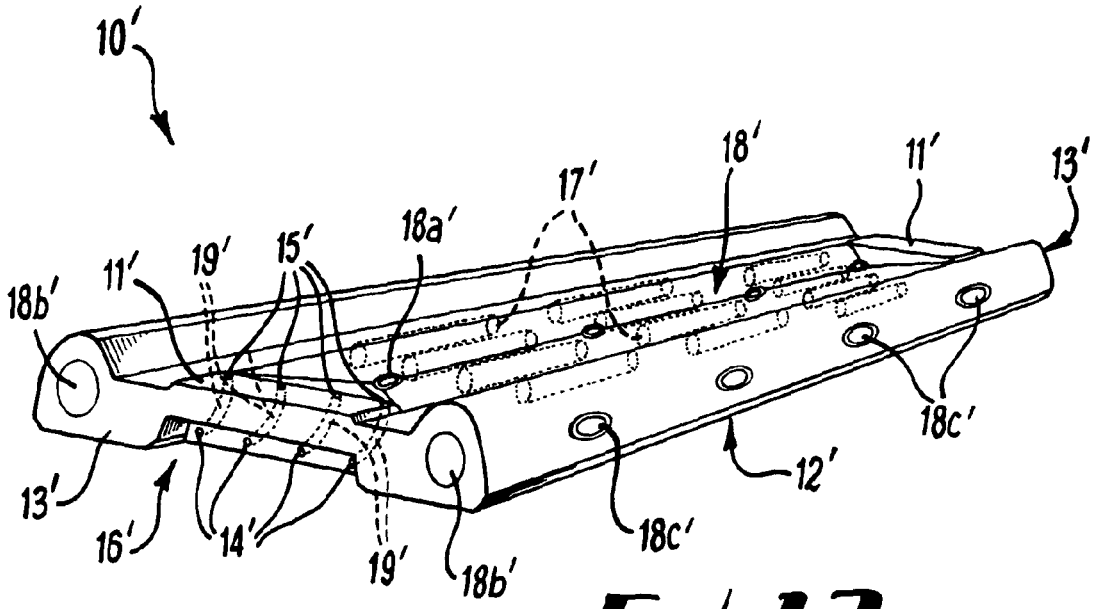
FIG. 13 is a perspective view of an alternative form of the modular slab shown in FIG. 1.
Figure 14:
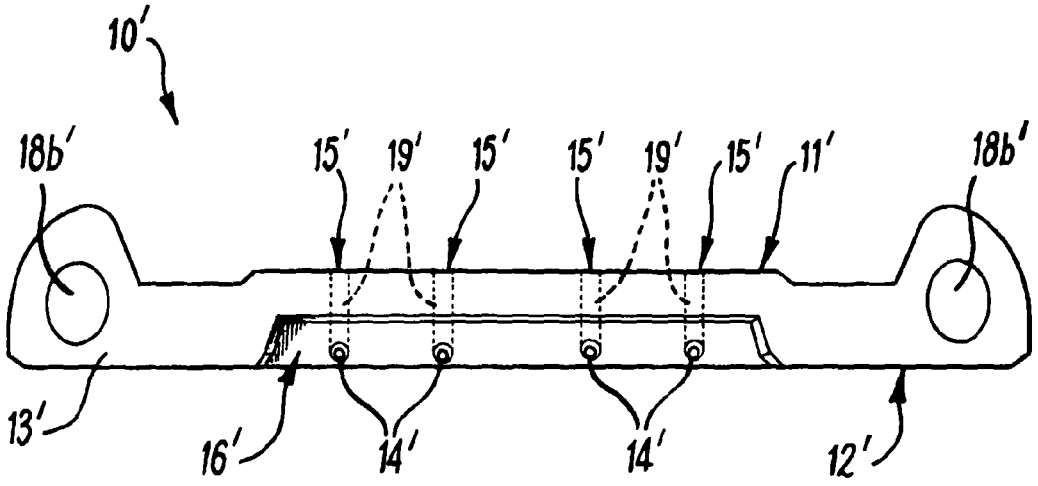
FIG. 14 is an end elevation view of the modular slab shown in FIG. 13.

FIGS. 13 and 14 show a modular slab 10' which is very similar to modular slab 10 shown in FIGS. 1 and 2; the similarity is such that like features have been provided with like reference numerals in FIGS. 13 and 14, however denoted with a prime symbol (′). The difference between slab 10' and slab 10 is in the end profile of the slabs resulting from the profile of channel 18' in slab 10' and channel 18 in slab 10. FIGS. 13 and 14 clearly show a taller height profile along both longitudinal edges defining channel 18', through which longitudinal ducts 18*b*' are provided.

Figure 15:
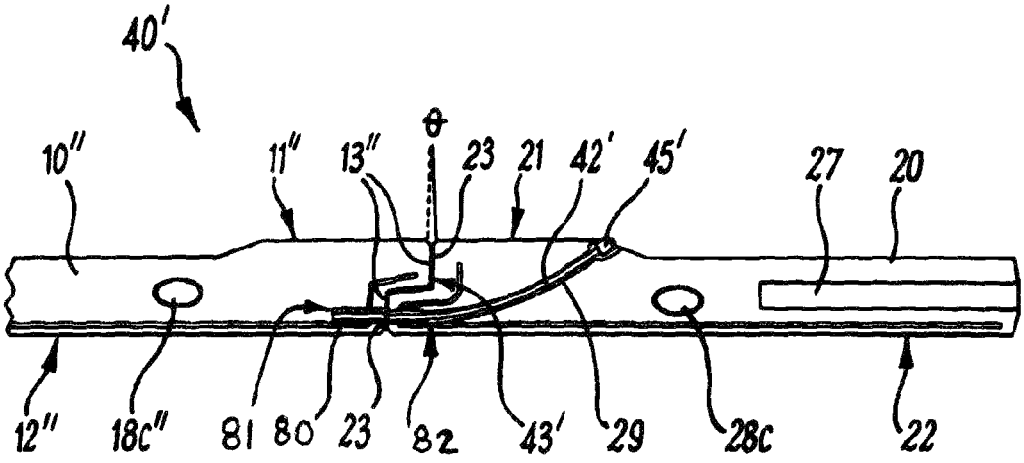
FIG. 15 is a side elevation view of a variant of the modular surface system shown in FIG. 9.

FIG. 15 shows a modular surface system 40' which is an alternative to modular surface system 40 shown in FIG. 9. Like features have been provided with like reference numerals in FIG. 15, however denoted with a prime (′) or double prime (″) symbol. The main difference between the systems shown in FIGS. 9 and 15 is in the second joining means 42' and corresponding alternative form of slab 10".

Slab 10" comprises a cavity 80 which extends from an aperture (not shown) in end surface 13" into the body of slab 10" and is provided therein with a tension-fixing anchoring ferrule 81. Slabs 10", 20 are end-to-end abutted to form a cooperative joint 43', such that the cavity 80 and conduit 29 in each slab meet and join to form an elongate cavity 82, which extends between the two slabs 10", 20. Into cavity 82 a second joining structure 42', in the form of a flexible wire cable or GFRP curved bar which can be made to follow an arcuate path, is located. The first end of cable/curved bar 42' screw-threads into ferrule 81 to anchor the cable into position, whilst the other end of the cable/curved bar 42' is provided with fastening and tensioning means 45' to lock the slabs 10, 20 into position and to provide strength to the joint 43'.

Cooperative joint 43' is again profiled such that the end surfaces 13, 23 that form the concavity 16" and protrusion 26 respectively lie at an angle of 5-10° to the vertical (as is shown by the angle e annotated on the drawing). By providing the surfaces of the joint in this manner, the two slabs 10", 20 are easier to align when laying the system 40'.

Figure 16:
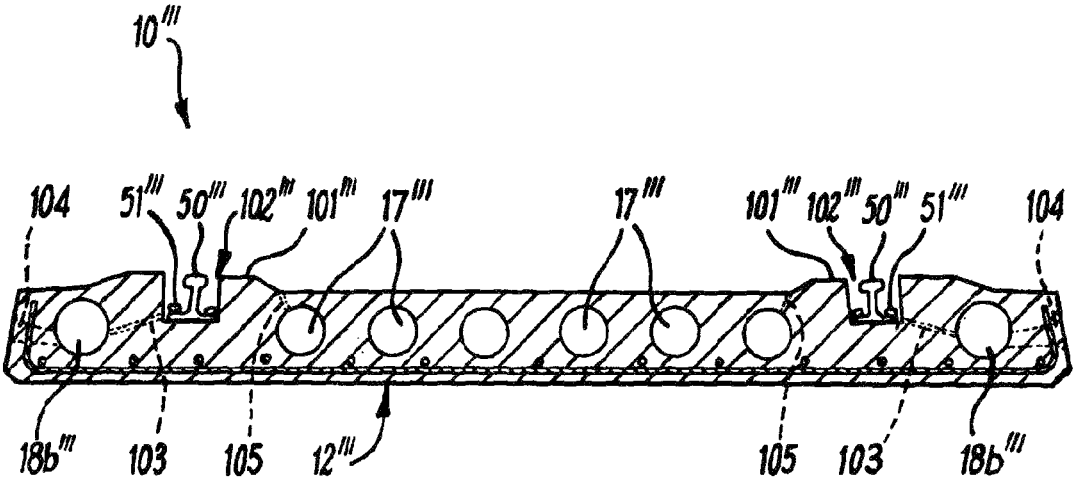
FIG. 16 is a transverse section through a yet further alternative modular slab, according to an exemplary embodiment.

FIG. 16 show a modular slab 10''' which is very similar to modular slab 10 shown in in FIG. 11; the similarity is such that like features have been provided with like reference numerals in FIG. 16, however denoted with a triple prime symbol (‴). The difference between slab 10''' and slab 10 is in the end profile of the slabs. FIG. 16 shows slab 10''' in use as a metro slab for city light rail systems. Slab 10''' is again provided with a rail/fixing component 50''' and a fixing 51''', however the upper surface 11''' has been modified to include two outer raised-profile portions 101'''—the edges of the slab 10''' are of greater depth when viewed in section compared to the center of the slab, which allows for the laying (in the shallower area) of road surfacing materials (not shown). Furthermore, upper surface 11''' is provided with two longitudinal recesses 102''' which accommodate the track 50''' and fixing 51''' components. In this way, the track 50''' is effectively embedded in the slab 10''', which may be especially useful as a metro track located in a highway or city streets. The modular slab 10''' can accommodate numerous ducts 17''' for cables associated with a metro system and recesses 102''' that are provided with drainage outlets 103, 104, 105 to allow for the collection, escape and drainage of surface and sub-surface collected water.

Figure 17:
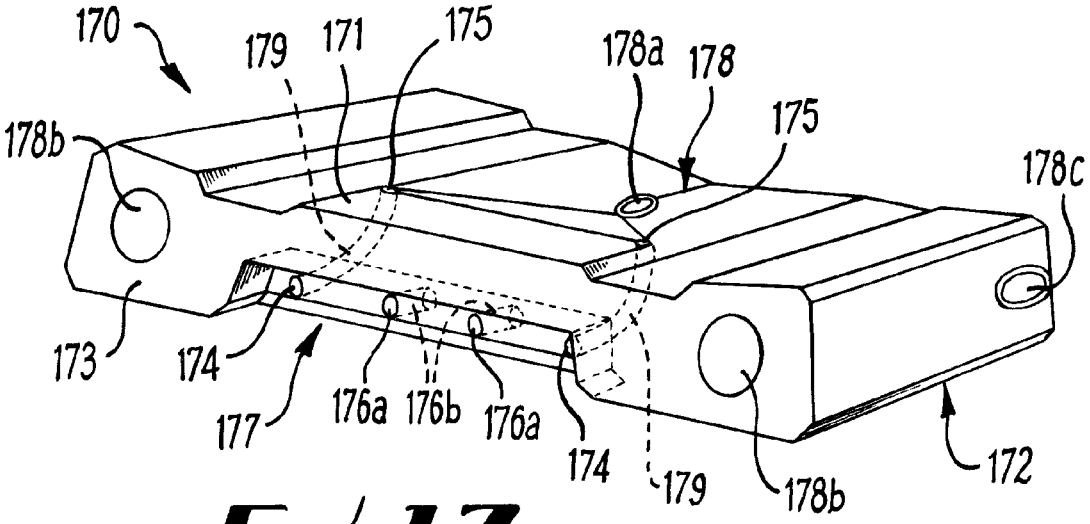
FIG. 17 is a perspective view of a further alternative modular slab according to the invention.

FIG. 17 shows a modular slab 170 comprising a first surface, in the form of an upper surface 171, a second surface, in the form of a lower surface 172 and two opposing end surfaces 173 (only one of which is shown). The slab 170 is elongate in the direction between the two end surfaces 173. The end surface 173 of the slab 170 shown in FIG. 17 is profiled to form a concavity 177. This profile extends part-way along the length of, and is centered on, the end surface 173. Located within the concavity 177 are two apertures 174, which correspond to a further two apertures 175 located in the upper surface 171 of the slab 170, adjacent to the end surface 173. A conduit 179 (shown in dotted outline) extends between each pair of apertures, joining them. Also located within the concavity 177 are two cavities 176*a* within each a ferrule 176*b* is provided.

Slab 170 also comprises a central elongate channel 178, which is provided along the longitudinal axis of the slab, along with drainage outlets 178*a*, for drainage of surface water which may otherwise stagnate on the slab's upper surface 171. On either side of channel 178 within the body of slab 170, two longitudinal ducts 178*b* may be provided, along with optional transverse ducts 178*c*.

Figure 18:
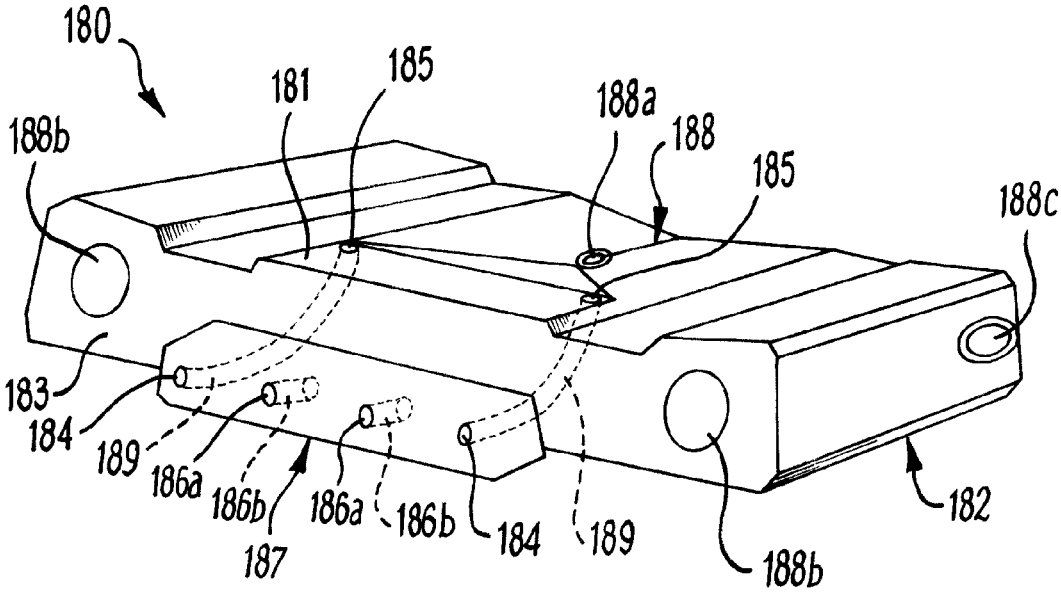
FIG. 18 is a perspective view of a further alternative modular slab according to the invention.

FIG. 18 shows a modular slab 180 similar to slab 170 shown in FIG. 17, in that slab 180 comprises a first surface, in the form of an upper surface 181, a second surface, in the form of a lower surface 182 and two opposing end surfaces 183 (only one of which is shown). The slab 180 is elongate in the direction between the two end surfaces 183. Slab 180 also comprises a central elongate channel 188, which is provided along the longitudinal axis of the slab, along with drainage outlets 188*a*, for drainage of surface water which may otherwise stagnate on the slab's upper surface 181. On either side of channel 188 within the body of slab 180, two longitudinal ducts 188*b* may be provided, along with optional transverse ducts 188*c*.

Slab 180 differs from slab 170 in that the end surface 183 of slab 180 is profiled to form a protrusion 187. This profile extends part-way along the length of, and is centered on, the end surface 183. Located on the protrusion 187 are two apertures 184, which correspond to a further two apertures 185 located in the upper surface 181 of the slab 180, adjacent to the end surface 183. A conduit 189 (shown in dotted outline) extends between each pair of apertures, joining them. Also located on the protrusion 187 are two cavities 186*a* within each a ferrule 186*b* is provided.

Figure 19:
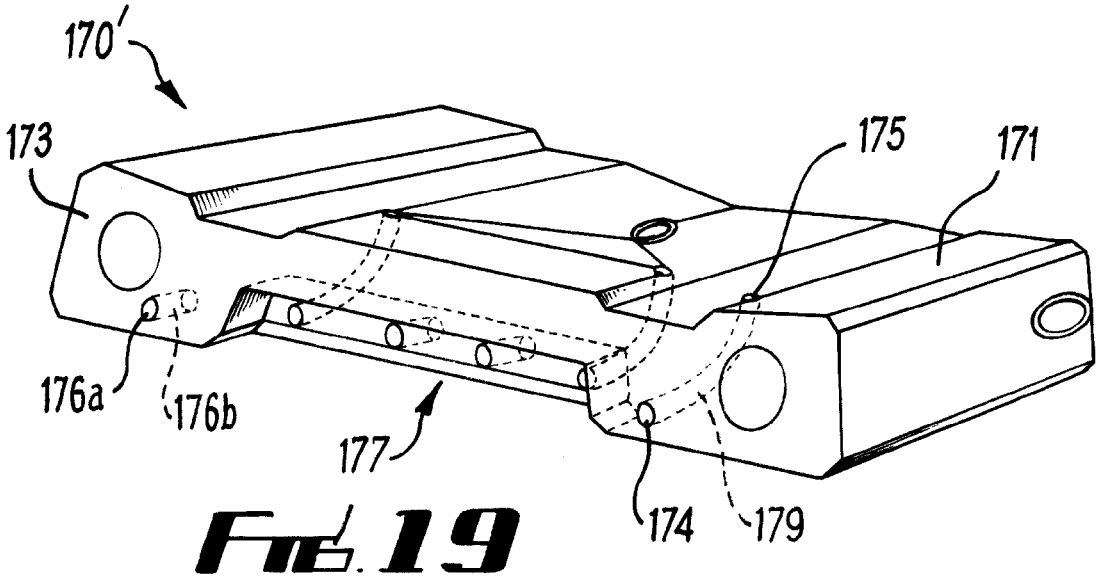
FIG. 19 is a perspective view of a further alternative modular slab according to the invention.

FIG. 19 shows a modular slab 170' which is very similar to modular slab 170 shown in FIG. 17; the similarity is such that only the differences will be described. As shown, slab 170' further includes (i) an aperture 174 in end surface 173 outside of concavity 177, which is joined to an aperture 175 in the upper surface 171 by a conduit 179 which extends between them, and (ii) a cavity 176*a* within which a ferrule 176*b* is provided.

Figure 20:
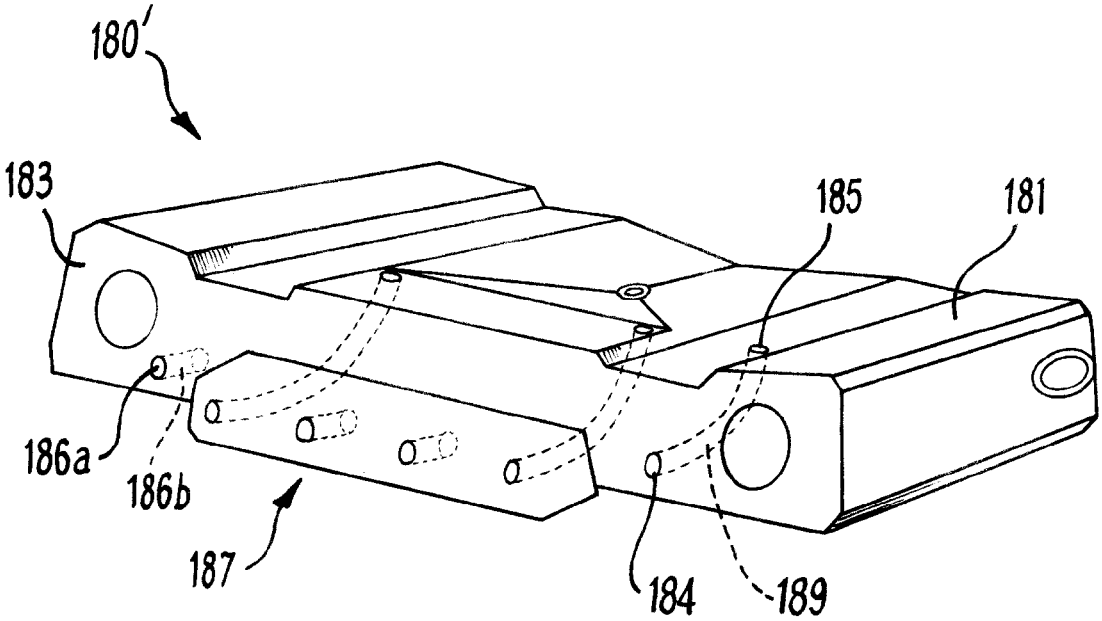
FIG. 20 is a perspective view of a further alternative modular slab according to the invention.

Similarly, FIG. 20 shows a modular slab 180' which is very similar to modular slab 180 shown in FIG. 18; the similarity is such that only the differences will be described. As shown, slab 180' further includes (i) an aperture 184 in end surface 183 outside of protrusion 187, which is joined to an aperture 185 in the upper surface 181 by a conduit 189 which extends between them, and (ii) a cavity 186*a* within which a ferrule 186*b* is provided.

Figure 21:
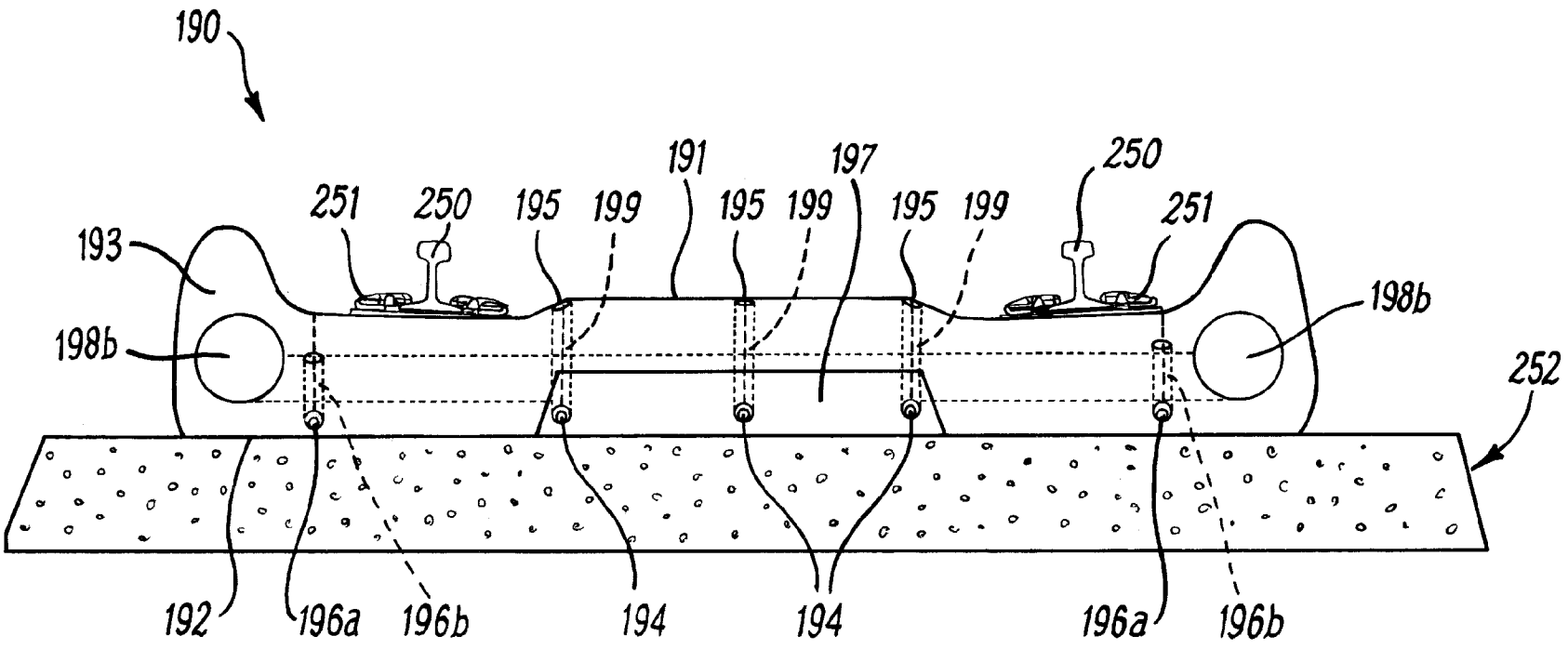
FIG. 21 is a side elevation of a further alternative modular slab according to the invention.

Finally, FIG. 21 shows a modular slab 190 in use as a railway track support. Slab 190 is laid on an existing railway ballast surface 252 and is provided with a railway track 250 and a fixing 251 for fixing the track 250 to the upper surface 191 of slab 190. Slab 190 comprises a first surface, in the form of an upper surface 191, a second surface, in the form of a lower surface 192 and two opposing end surfaces 193 (only one of which is shown). The slab 190 is elongate in the direction between the two end surfaces 193. The end surface 193 of the slab 190 shown in FIG. 21 is profiled to form a concavity/protrusion 197. This profile extends part-way along the length of, and is centered on, the end surface 193. Located within the concavity/on the protrusion 197 are three apertures 194, which correspond to a further three apertures 195 located in the upper surface 191 of the slab 190, adjacent to the end surface 193. A conduit 199 (shown in dotted outline) extends between each pair of apertures, joining them. Also located outboard of the concavity/protrusion 197 are two cavities 196*a*, one on each side of the concavity/protrusion 197, within each a ferrule 196*b* is provided.

Slab 190 also comprises a central elongate channel (not shown), which is provided along the longitudinal axis of the slab, along with drainage outlets (not shown), for drainage of surface water which may otherwise stagnate on the slab's upper surface 191. On either side of the channel within the body of slab 190, two longitudinal ducts 198*b* are provided.

What is claimed is:

1. A modular surface system for use in construction, comprising:
   - at least four modular slabs connected in series;
   - each modular slab including:
     - an upper surface, a lower surface opposed to the upper surface, and first and second opposing end surfaces between and substantially normal to the upper and lower surfaces; and wherein the at least four slabs are end-to-end abutted with one another, and adjacent said slabs comprise:
   - a first slab including a conduit extending from an aperture in the upper surface to an aperture in an end surface; and
   - a modular second slab provided with a conduit extending from an aperture in the upper surface thereof to an aperture in an end surface thereof, and
   - a joining structure which can be unjoined;
   - wherein the conduit in the first slab is mated with the conduit in the second slab so as to form an elongate conduit through the ends of the two slabs, the elongate conduit being accessible through the apertures in the upper surfaces of each slab, and the joining structure being located through such apertures and conduits to join the two slabs together;
   - wherein the elongate conduit is arcuate or parabolic and the joining structure is a cable or tie, and, when the joining structure is securing two slabs together, the cable or tie is removably located in the elongate conduit with the cable or tie being under tension and fastened at the upper surfaces of each of the two slabs;
   - and wherein:
   - at each joint between two slabs of the series, the end surface of one slab includes a protrusion and the end surface of the other slab includes a corresponding concavity such that a cooperative joint is formed where the two slabs are abutted together, such that, when each joining structure is unjoined, one of the middle two slabs can be removed in a non-destructive manner leaving the other slabs in place; and
   - each slab has a pair of railway tracks or metro tracks mounted thereon whereby each slab is configured to support a vehicle traveling on the pair of railway tracks or metro tracks.

2. The system of claim 1, wherein the end surface profile extends along the length of the end surface of both slabs.

3. The system of claim 1, wherein the end surface profile extends part-way along the length of the end surface of both slabs.

4. The system of claim 1, wherein the first slab is a type-A slab having two identically profiled end surfaces, and wherein the second slab is a type-B slab also having two identically profiled end surfaces, and wherein the profiles of the type-A and type-B slabs are different but cooperative when respective end surfaces are in abutment.

5. The system of claim 1, wherein the first slab has two differently profiled end surfaces, the profile of one said end surface being cooperable with the profile of the other said end surface, the first slab defining a type-C slab.

6. The system of claim 1, wherein the slabs are pre-cast or pre-molded from a construction material.

7. The system of claim 6, wherein the construction material is fibre-reinforced concrete, reinforced concrete, or a plastics material.

8. The system of claim 6, wherein the slabs have one or more voids in them, thereby reducing weight.

9. The system of claim 1, wherein the slabs include one or more channels in at least one of the upper surfaces.

10. The system of claim 1, wherein the slabs include one or more longitudinal ducts and/or one or more transverse ducts therewithin.

11. The system of claim 10, wherein the ducts are water drainage ducts.

12. The system of claim 10, wherein the ducts are cable ducts.

13. The system of claim 1, wherein the slabs are structured as a railway track support, and wherein the railway track is supportable on the upper surface of the plurality of modular slabs.

14. The system of claim 1, wherein the slabs are structured as a metro track support, and wherein the metro track is embedded in the upper surface of the plurality of modular slabs.

15. The system of claim 1, wherein the plurality of modular slabs are joined with first or second joining structures to respectively form a monolithic railway or metro track support.

16. The system of claim 1, wherein the slabs are assembled directly on an existing railway ballast surface.

17. The system of claim 1, wherein the protrusion and cavity of each slab is shaped such that the end surface of each protrusion and concavity is at an angle of 45° or less to the vertical.

18. The system of claim 1, wherein the protrusion and cavity of each slab is shaped such that the end surface of each protrusion and concavity is at an angle of less than 25° to the vertical.

19. The system of claim 1, wherein the protrusion and cavity of each slab is shaped such that the end surface of each protrusion and concavity is at an angle of less than 15° to the vertical.

20. The system of claim 1, wherein the protrusion and cavity of each slab is shaped such that the end surface of each protrusion and concavity is at an angle of 520 to 10° to the vertical.

21. The system of claim 1, wherein each slab defines one or more voids therewithin filled with aerated or foamed rubber.

22. The system of claim 1, wherein the end surfaces of the slabs are ungrouted.

23. The system of claim 1, wherein the joining structure is ungrouted.

24. The system of claim 1, wherein the concavity of one middle slab is open downwards.

25. A modular surface system for use in construction, comprising:

at least four modular slabs connected in series;

each modular slab having:

an upper surface, a lower surface opposed to the upper surface, and first and second opposing end surfaces between and substantially normal to the upper and lower surfaces; and a plurality of conduits, each of the conduits extending from an aperture in the upper surface to an aperture in an end surface;

wherein the at least four slabs are end-to-end abutted with one another, and adjacent said slabs comprise a first modular slab and a second modular slab the second slab being provided with a plurality of conduits, each of the conduits extending from an aperture in the upper surface thereof to an aperture in an end surface thereof; and a joining structure that joins the two slabs together, the joining structure passing through one of the conduits and being capable of being unjoined;

wherein the plurality of conduits in the first slab are mated with the plurality of conduits in the second slab so as to form a plurality of elongate conduits through the ends of the two slabs, and wherein both the first and second modular slabs have a respective plurality of conduits extending from an aperture in their upper surfaces to an aperture in their end surfaces;

wherein each of the elongate conduits is arcuate or parabolic and the joining structure is a cable or tie, and, when the joining structure is securing two slabs together, the cable or tie is removably located in the elongate conduit with the cable or tie being under tension and fastened at the upper surfaces of each of the two slabs;

and at each joint between two slabs of the series, the end surface of one slab includes first and second discontinuous protrusions and the end surface of the other slab includes corresponding first and second discontinuous concavities such that a cooperative joint is formed where the two slabs are abutted together, such that, when each joining structure is unjoined, one of the middle two slabs can be removed in a non-destructive manner leaving the other in place, and wherein at least one of the apertures in the end surfaces are disposed on each of the first and second protrusions and on each of the first and second concavities.

26. The system of claim 25, wherein the first slab is a type-A slab having two identically profiled end surfaces, and wherein the second slab is a type-B slab also having two identically profiled end surfaces, and wherein the profiles of the type-A and type-B slabs are different but cooperative when respective end surfaces are in abutment.

27. The system of claim 25, wherein the slabs are structured as a railway or metro track support.

28. The system of claim 25, wherein the slabs are structured as one of flooring in a building, base for a highway, a runway of an airport, or a surface at a port or freight terminal.

29. A method of removing a construction slab from the middle of a series of at least four slabs that have been laid, each slab including:

an upper surface, a lower surface opposed to the upper surface, and first and second opposing end surfaces between and substantially normal to the upper and lower surfaces; and wherein the at least four slabs are end-to-end abutted with one another and adjacent slabs comprise:

a first slab including a conduit extending from an aperture in the upper surface to an aperture in an end surface; and a modular second slab, being provided with a conduit extending from an aperture in the upper surface thereof to an aperture in an end surface thereof; and a joining structure which can be unjoined;

wherein the conduit in the first slab is mated with the conduit in the second slab so as to form an elongate conduit through the ends of the two slabs, the elongate conduit being accessible through the ends of the two slabs, the elongate conduit being accessible through the apertures in the upper surfaces of each slab, and the joining structure being located through such apertures and conduits to join the two slabs together;

wherein the elongate conduit is arcuate or parabolic and the joining structure is a cable or tie, and, when the joining structure is securing two slabs together, the cable or tie is removably located in the elongate conduit with the cable or tie being under tension and fastened at the upper surfaces of each of the two slabs;

and at each joint between two slabs of the series the end surface of one slab includes a protrusion and the end surface of the other slab includes a corresponding concavity such that a cooperative joint is formed where the two slabs are abutted together, and wherein the aperture in the end surface of the one slab is disposed on the protrusion and the aperture in the end surface of the other slab is disposed on the corresponding concavity;

the method comprising: while leaving the adjacent laid slabs in place, unjoining the joining structures joining the middle slab to adjacent slabs and lifting the middle slab out in a manner which is non-destructive to the adjacent slabs.

30. A railway or metro track support, the support comprising a plurality of slabs laid end to end, each slab comprising:

an upper surface, a lower surface opposed to the upper surface, and first and second opposing end surfaces between and substantially normal to the upper and lower surfaces, and a pair of railway tracks or metro tracks mounted on the upper surface; and a conduit extending from an aperture in the upper surface to an aperture in an end surface;

wherein the slab is end-to-end abuttable with a second removable modular slab;

said second slab having an upper surface, a lower surface opposed to the upper surface, and first and second opposing end surfaces between and substantially normal to the upper and lower surfaces, and said second slab being provided with a conduit extending from an aperture in the upper surface thereof to an aperture in an end surface thereof;

whereby the conduit in the first-mentioned slab is mateable with the conduit in the second slab so as to form an elongate conduit through the ends of the two slabs, which is accessible through the apertures in the upper surfaces of each slab, and through which a joining means is removably locatable to join the two slabs together;

wherein the elongate conduit is arcuate or parabolic and the joining structure is a cable or tie, and, when the joining structure is securing two slabs together, the cable or tie is removably located in the elongate conduit with the cable or tie being under tension and fastened at the upper surfaces of each of the two slabs;

wherein each slab includes a raised portion, which extends longitudinally down each side of the upper surface of each slab; and at each joint between two slabs of the series, the end surface of one slab includes a protrusion and the end surface of the other slab includes a corresponding concavity such that a cooperative joint is formed where the two slabs are abutted together, such that, when each joining structure is unjoined, one of the middle two slabs can be removed in a non-destructive manner leaving the other slabs in place and wherein the apertures in the end surfaces of the slabs are disposed on the protrusion and corresponding concavity.

31. The support of claim 30, wherein the raised portion is at least as tall as a rail supported by each slab.

32. The support of claim 30, wherein the raised portion is taller than a rail supported by each slab.

* * * * *